US007261402B2

(12) United States Patent
Taniguchi et al.

(10) Patent No.: US 7,261,402 B2
(45) Date of Patent: Aug. 28, 2007

(54) INK CONTAINER, INK-JET RECORDING HEAD, AND INK-JET RECORDING APPARATUS

(75) Inventors: Suguru Taniguchi, Kawasaki (JP); Koichi Omata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 375 days.

(21) Appl. No.: 11/109,159

(22) Filed: Apr. 19, 2005

(65) Prior Publication Data

US 2005/0231570 A1 Oct. 20, 2005

(30) Foreign Application Priority Data

Apr. 20, 2004 (JP) ..... 2004-124253

(51) Int. Cl.
*B41J 2/175* (2006.01)

(52) U.S. Cl. ..... 347/86; 347/87

(58) Field of Classification Search ..... 347/85, 347/86, 87

See application file for complete search history.

(56) References Cited

U.S. PATENT DOCUMENTS 6,540,321 B1 4/2003 Hirano et al.
6,637,872 B2 * 10/2003 Ara et al. ..... 347/85
6,840,610 B2 * 1/2005 Taniguchi et al. ..... 347/86
6,966,637 B2 * 11/2005 Ishizaki ..... 347/85
6,966,641 B2 * 11/2005 Taniguchi et al. ..... 347/86

FOREIGN PATENT DOCUMENTS

JP 8-11291 A 1/1996

* cited by examiner

*Primary Examiner*—Anh T. N. Vo
(74) *Attorney, Agent, or Firm*—Canon U.S.A. Inc I.P. Div

(57) ABSTRACT

An ink container for supplying ink to an ink-jet recording element. The ink container includes a container body, a gas liquid separator, and an exhaust chamber cover. The container body includes an ink chamber and an exhaust chamber through which air is exhausted from the ink chamber. The ink chamber is provided with an ink outlet and an ink inlet. The exhaust chamber is provided with a vent. The gas liquid separator is disposed between the ink chamber and the exhaust chamber. The exhaust chamber cover covers the exhaust chamber. When the outside temperature changes, rate of temperature change of the inner surface of the exhaust chamber cover is slower than that of the inner surface of the container body.

9 Claims, 7 Drawing Sheets

INK CONTAINER, INK-JET RECORDING HEAD, AND INK-JET RECORDING APPARATUS

BACKGROUND OF THE INVENTION

1. Field of the Invention

The present invention relates to an ink container that is used for a pit-stop-type ink-jet recording head and is provided with a gas liquid separator; an ink-jet recording head; and an ink-jet recording apparatus.

2. Description of the Related Art

In ink-jet recording apparatuses, as shown in FIG. 4, a recording head 101 is guided by a guide shaft 108, and horizontally scans a recording medium to perform recording. Methods widely used for supplying ink include "a head cartridge method" and "a tube supply method."

In the head cartridge method, as shown in FIG. 4, a head cartridge 101*b* is mounted on a carriage 101*a*. The head cartridge 101*b* includes the recording head 101 and a main tank 104 integrated with each other. The recording head 101 is provided with nozzles for discharging ink. The main tank 104 holds ink. The carriage 101*a* moves along the guide shaft 108 so that the head cartridge 101*b* can move to perform printing.

In the tube supply method, as shown in FIG. 5, only a head cartridge 201 is mounted on a carriage 201*a*. A tank cartridge 201*c* containing ink is disposed in the main body of the recording apparatus. The recording head 201 and the tank cartridge 201*c* are connected via a flexible ink supply tube 201*d* so that ink can be supplied from the tank cartridge to the recording head 201.

In the head cartridge method, as described above, the head cartridge 101*b* mounted on the carriage 101*a* holds ink. Therefore, the weight of ink hinders the carriage 101*a* from moving at a high velocity. If the size of the head cartridge 101*b* is reduced in order to reduce the weight, the number of printable sheets is also reduced.

In the tube supply method, as described above, the recording head 201 and the tank cartridge 201*c* are connected via the ink supply tube 201*d*. Therefore, the mechanism is complex, and it is difficult to reduce the size of the ink-jet recording apparatus.

In order to solve these problems, a "pit-stop-type" ink-jet recording apparatus has been devised. In the pit stop method, only a recording head is mounted on a carriage. When the carriage is in the home position or a predetermined position, a predetermined amount of ink is supplied to the recording head on the carriage.

FIG. 6 is a perspective view showing a pit-stop-type ink-jet recording apparatus. As shown in FIG. 6, a recording head 301 is mounted on a carriage 301*a*. A paper feed roller 321 carries recording paper 320. The recording head 301 performs recording on the paper 320. The carriage 301*a* is guided by a guide shaft 308. A main tank 304 is disposed at a home position 323. Ink is supplied from the main tank 304 to a sub-tank 303 of the recording head 301. The main tank 304 is provided with a joint 310 to be connected to an ink inlet 311 of the sub-tank 303. A covering cap 306 seals and protects an ink-jet recording element. An ink suction cap 305 sucks ink from nozzles of the ink-jet recording element. An air suction cap 322 sucks air from a vent 315 of the sub-tank 303. The ink suction cap 305 and the air suction cap 322 communicate with a negative-pressure generator 307.

The pit stop operation in this ink-jet recording apparatus will be described. When recording is not performed, the recording head 301 is on standby in the home position 323 where the recording head 301 can be connected with the ink suction cap 305, the air suction cap 322, the covering cap 306, and the main tank 304. When the main body of the recording apparatus receives a printing signal, the covering cap 306 seals the discharging ports of the ink-jet recording element, and the joint 310 of the main tank 304 is connected to the ink inlet 311 of the sub-tank 303. Next, the air suction cap 322 is connected to the vent 315 of the sub-tank 303. The negative-pressure generator 307 operates to reduce the pressure inside the sub-tank 303. In this way, ink is supplied from the main tank 304 to the sub-tank 303.

Next, a recovering operation is carried out in order to clear the nozzles clogged with thickened ink and to recover a good discharging performance. In this recovering operation, the vent 315 and the ink inlet 311 of the sub-tank 303 are disconnected from the air suction cap 322 and the joint 310, respectively. Next, the ink suction cap 305 is connected to the ink-jet recording element. The negative-pressure generator 307 operates to suck the ink in the nozzles. After the suction of ink, the ink adhering to the discharging surface of the recording head 301 is wiped. Next, a preliminary discharge is performed in order to remove the mixed ink that is forced to enter the nozzles by wiping. Next, recording to the recording paper 320 is started.

As described above, in the pit stop method, only the ink-jet recording element and the sub-tank 303 are mounted on the carriage 301*a*. Since the load of the carriage 301*a* is light, the ink-jet recording head 301 can scan at comparatively high velocity. In addition, in this pit stop method, ink is supplied from the main tank 304 in the home position 323. Therefore, the number of printable sheets can be increased. Moreover, unlike the tube supply method, it is unnecessary to connect the carriage 301*a* and the main tank 304 with an ink supply tube. Therefore, the structure of the ink-jet recording apparatus is more simple.

Japanese Patent Laid-Open No. 08-112913 discloses an ink supply mechanism for a pit-stop-type ink-jet recording apparatus. In this ink supply mechanism, at the pit stop, a sensor detects the amount of ink that can be supplied to the sub-tank, and an ink supply system is controlled accordingly. However, this mechanism is very complex and delicate, and therefore the cost of manufacturing is high.

In order to solve this problem, a pit-stop-type ink-jet recording head whose sub-tank is provided with a gas liquid separator has been proposed. FIG. 7A is a sectional view showing a pit-stop-type ink-jet recording head provided with a gas liquid separator. FIG. 7B is a sectional view taken along line B-B of FIG. 7A.

This ink-jet recording head is mounted on the ink-jet recording apparatus shown in FIG. 6. As shown in FIGS. 7A and 7B, an ink chamber of a sub-tank 403 communicates with an ink inlet 411 of an ink inlet pipe 412. Ink absorbers 437 are disposed in the ink chamber. The ink absorbers 437 absorb and hold the ink coming in through the ink inlet 411. A gas liquid separator 433 is fixed to the container body 435, and disposed on the boundary between an exhaust chamber 436 and the ink chamber. The gas liquid separator 433 allows gas to pass through but blocks liquid such as ink. A porous film with a thickness of tens of micrometers formed of, for example, polytetrafluoroethylene (PTFE) is used as the gas liquid separator 433.

As shown in FIG. 7B, the ink chamber is divided into three sections. The gas liquid separator 433 is welded on the inner rib of the container body 435 so as to separate the three sections from the exhaust chamber 436. In addition, an exhaust chamber cover 434 is welded on the edge at the top of the container body 435 so as to cover the exhaust chamber 436. The exhaust chamber cover 434 is formed of polysulfone resin, which is the same material as that of the container body 435. The exhaust chamber 436 is shared by the three sections of the ink chamber.

The ink supply operation in the above ink-jet recording head will be described. When the main body of the recording apparatus receives a printing signal, a covering cap 406 seals the discharging ports of the ink-jet recording element 438, and a joint 410 of a main tank (not shown) is connected to the ink inlet 411 of the sub-tank 403. Next, an air suction cap 422 is connected to a vent 415 of the sub-tank 403. A negative-pressure generator operates so as to exhaust the air from the ink chamber through the gas liquid separator 433 and the vent 415.

As a result, the pressure in the sub-tank 403 is reduced. Ink is supplied to the ink chamber through the joint 410 and the ink inlet 411 so as to refill the ink chamber. Just after this ink supply, in order to prevent defective discharge of ink, the recovering operation, the wiping, and the preliminary discharge are performed. Next, recording to the recording medium is started.

When the amount of air sucked by the negative-pressure generator is larger than or equal to the inner volume of the sub-tank 403, the air is exhausted from the ink chamber through the gas liquid separator 433 regardless of the amount of ink remaining in the ink chamber, and the ink chamber is refilled with the ink supplied from the main tank. As described above, the negative-pressure generator only has to suck at least a certain amount of air in order to refill the ink chamber. Therefore, it is unnecessary to control the air suction. When the amount of air that the negative-pressure generator can suck is sufficiently large, this ink supply method can easily be feasible in principle.

As described above, generally, the container body 435 is formed of a resin material with an injection molding machine. Since the exhaust chamber cover 434 is joined to the container body 435 by heat welding or ultrasonic welding, the exhaust chamber cover 434 is formed of the same resin material as that of the container body 435, and thin.

Therefore, the heat capacity of the exhaust chamber cover 434 is small in comparison with that of the container body 435. In addition, in order to minimize the size of the ink-jet recording head, the distance between the gas liquid separator 433 and the exhaust chamber cover 434 is very small. On the other hand, the volume of the ink chamber is large in comparison with that of the exhaust chamber 436. Therefore, after completion of printing, some ink remains in the ink chamber. The specific heat of ink is greater than that of air.

Therefore, the heat capacity on the exhaust chamber side of the gas liquid separator 433 is very small in comparison with that on the ink chamber side. Therefore, in the ink-jet recording head, when the environment temperature changes, the difference in rate of temperature change between both sides of the gas liquid separator 433 is very large.

Consequently, if the ink-jet recording apparatus is shifted from a room temperature environment to a cool temperature environment, for example, from 25° C. to −20° C., dew condensation occurs on the surface and in the pores of the gas liquid separator 433. In addition, if the ink-jet recording apparatus is returned to a room temperature environment, and then the pit-stop-type ink supply is performed, the ink in the ink chamber leaks through the gas liquid separator 433 into the exhaust chamber 436.

In the ink-jet recording head shown in FIGS. 7A and 7B, the exhaust chamber cover 434 is formed of polysulfone resin, 2 mm in thickness, and 9 $cm^2$ in area. The distance between the exhaust chamber cover 434 and the gas liquid separator 433 is 1 mm. The full capacity of each of the three sections of the ink chamber is about 0.5 cc, and each section contains about 0.3 cc of ink.

When the specific heat of polysulfone resin is 1.3 J/g·K, the specific heat of ink is 4.1 J/g·K, and the specific heat of air is 1 J/g·K, the heat capacity on the exhaust chamber side of the gas liquid separator 433 is approximately 2.8 J·K, and the heat capacity on the ink chamber side is approximately 15.1 J·K. Therefore, the heat capacity on the exhaust chamber side is about one-fifth of that on the ink chamber side.

FIG. 8 shows the temperature change on the exhaust chamber side of the gas liquid separator 433 and the temperature change on the ink chamber side of the gas liquid separator 433 when the ink-jet recording head is shifted from a room temperature environment to a cool temperature environment of −20° C. In FIG. 8, the solid line $L_3$ shows the temperature change on the exhaust chamber side of the gas liquid separator 433, and the dashed line $L_4$ shows the temperature change on the ink chamber side of the gas liquid separator 433.

Since the heat capacity on the exhaust chamber side of the gas liquid separator 433 is smaller than that on the ink chamber side, the rate of temperature change on the exhaust chamber side is faster than that on the ink chamber side. Therefore, as shown in FIG. 8, when the temperature on the exhaust chamber side ($L_3$) changes from room temperature to 0° C., it is about 5° C. lower than the temperature on the ink chamber side ($L_4$).

FIGS. 9A to 9C are schematic sectional views showing the state on the surface and in the pores of the gas liquid separator 433. How ink leaks through the gas liquid separator 433 will be described. In FIGS. 9A to 9C, for the sake of convenience, the pores in the gas liquid separator 433 are shown schematically. However, as described above, the real gas liquid separator 433 is a thin film with a thickness of tens of micrometers. Since the heat capacity of the gas liquid separator 433 is small, the rate of temperature change of the gas liquid separator 433 is close to that on the exhaust chamber side of the gas liquid separator 433.

On the other hand, the ink chamber is filled with a gas whose temperature is higher than that of the gas liquid separator 433. In addition, since ink remains in it, it contains a large amount of water vapor. Therefore, as shown in FIG. 9A, the air in the ink chamber is cooled on the ink-chamber-side surface and in the pores of the gas liquid separator 433, and dew condensation 414 occurs on the ink-chamber-side surface and in the pores of the gas liquid separator 433. When the temperature becomes 0° C. or less, the dew condensation 414 and ink 413 freeze.

When the ink-jet recording head is returned to a room temperature environment, the dew condensation 414 and ink 413 melt. As shown in FIG. 9B, since water 414 exists on the ink-chamber-side surface and in the pores of the gas liquid separator 433, ink 413 adheres to the ink-chamber-side surface of the gas liquid separator 433. Therefore, the meniscus force of melted ink 413 is lost, and ink 413 enters the pores. In this way, ink passages are formed.

If the pit-stop-type ink supply operation is repeated under such condition, as shown in FIG. 9C, ink 413 leaks gradually through the ink passages into the exhaust chamber 436. If a large amount of ink 413 leaks into the exhaust chamber 436, and the exhaust-chamber-side surface of the gas liquid separator 433 is covered by ink 413, the permeability of the gas liquid separator 433 deteriorates significantly. Therefore, it can become difficult to normally supply the ink-jet recording element with ink 413.

In addition, if the ink 413 leaks from the vent (not shown), the insides of the ink-jet recording apparatus can be soiled with ink, and when recording is performed, the recording paper can be soiled with ink. The above-described phenomenon is not limited to the case where the ink-jet recording head is shifted from a room temperature environment to a cool temperature environment below 0° C. As long as dew condensation occurs, the phenomenon occurs in any case, for example, in the case where the ink-jet recording head is shifted from a high temperature and humid environment of 60° C. and 90% to a room temperature environment.

SUMMARY OF THE INVENTION

The present invention is directed to a more compact, lower cost, more reliable ink container in which ink leakage through a gas liquid separator is prevented; an ink-jet recording head including the ink container; and a recording apparatus including the ink container.

In one aspect of the present invention, an ink container includes a container body, a gas liquid separator, and an exhaust chamber cover. The container body includes an ink chamber and an exhaust chamber facilitating exhausting air from the ink chamber. The ink chamber is provided with an ink outlet and an ink inlet. The exhaust chamber is provided with a vent. The gas liquid separator is disposed between the ink chamber and the exhaust chamber. The exhaust chamber cover covers the exhaust chamber and configured such that, when the outside temperature changes, a rate of temperature change of an inner surface of the exhaust chamber cover is slower than that of an inner surface of the container body.

In the ink container according to the present invention, exhausting air from the ink chamber causes ink to enter the ink chamber through the ink inlet. Since rate of temperature change of the inner surface of the exhaust chamber cover is slower than that of the inner surface of the container body, when the outside temperature changes, the difference in rate of temperature change between both sides of the gas liquid separator is small. Therefore, dew condensation is prevented from occurring in the pores of the gas liquid separator, and the ink leakage through the gas liquid separator is reduced.

In another aspect of the present invention, an ink-jet recording head incorporates the above ink container.

In yet another aspect of the present invention, an ink-jet recording apparatus incorporates the above ink container.

Further features and advantages of the present invention will become apparent from the following description of exemplary embodiments (with reference to the attached drawings).

DESCRIPTION OF THE EMBODIMENTS

The embodiments of the present invention will now be described with reference to the drawings.

First Embodiment

The ink-jet recording head according to a first embodiment is mounted on a pit-stop-type ink-jet recording apparatus.

Figure 1A:
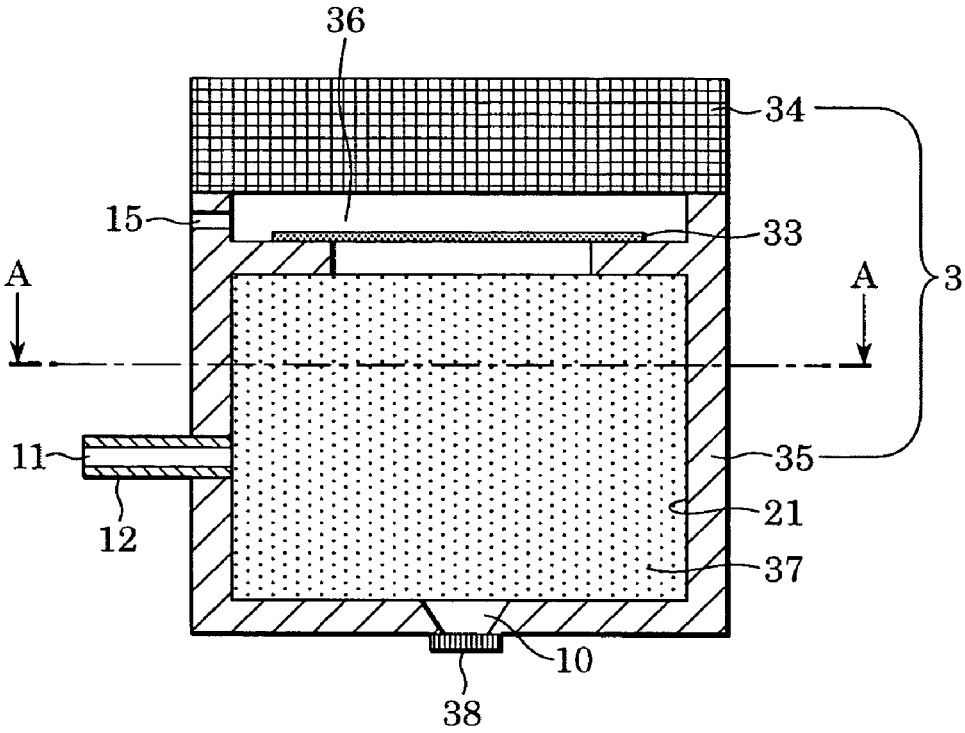
FIGS. 1A and 1B are schematic sectional views showing an ink-jet recording head with a gas liquid separator according to a first embodiment.
Figure 1B:
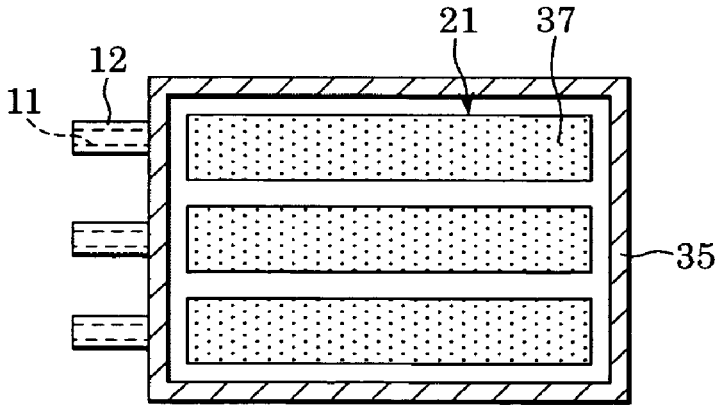

FIG. 1A is a sectional view showing the ink-jet recording head according to the first embodiment. FIG. 1B is a sectional view taken along line A-A of FIG. 1A.

As shown in FIGS. 1A and 1B, the ink-jet recording head according to the first embodiment includes an ink container 3 and an ink-jet recording element 38. The ink container 3 holds ink supplied from a main tank (not shown) disposed in the main body of the ink-jet recording apparatus. Being supplied with ink from the ink container 3, the ink-jet recording element 38 discharges ink.

The ink container 3 includes a container body 35, an exhaust chamber cover 34, and a gas liquid separator 33. The container body 35 has an ink chamber 21 for holding ink, and an exhaust chamber 36 through which air is exhausted from the ink chamber 21. The exhaust chamber cover 34 covers the exhaust chamber 36. The gas liquid separator 33 is disposed between the ink chamber 21 and the exhaust chamber 36.

The container body 35 is formed of polysulfone resin. As described above, the container body 35 has the ink chamber 21 inside. The ink chamber 21 is provided with an ink outlet 10 and an ink inlet pipe 12. The ink outlet 10 is for supplying ink to the ink-jet recording element 38. The ink inlet pipe 12 is for supplying ink from the outside main tank to the ink chamber 21. The ink inlet pipe 12 has an ink inlet 11. The ink inlet pipe 12 is formed of stainless steel into a cylindrical shape, and communicates with the ink chamber 21.

Ink absorbers 37 for absorbing the supplied ink are provided in the ink chamber 21. These ink absorbers 37 are formed of, for example, polypropylene (PP) fiber.

The exhaust chamber cover 34 is formed of polysulfone resin. As described above, the exhaust chamber cover 34 covers the exhaust chamber 36, and faces the gas liquid separator 33. The exhaust chamber 36 is provided with a vent 15 through which the air is exhausted from the ink chamber 21. The vent 15 can be connected with an air suction cap (not shown) so that a negative-pressure generator can suck the air.

The gas liquid separator 33 is a porous film formed of polytetrafluoroethylene (PTFE).

The ink-jet recording element 38 is disposed so as to face the recording paper. The ink-jet recording element 38 has nozzles (not shown) for discharging ink. These nozzles communicate with the ink outlet 10 of the ink container 3.

Air is exhausted from the ink chamber 21 through the exhaust chamber 36 and the vent 15. Ink is supplied to the ink chamber 21 through the ink inlet 11.

In the ink-jet recording head according to the first embodiment, the thickness of the exhaust chamber cover 34 is about 15 mm, and is 7.5 times that of the exhaust chamber cover 434 in the above-described conventional ink-jet recording head.

Figure 7A:
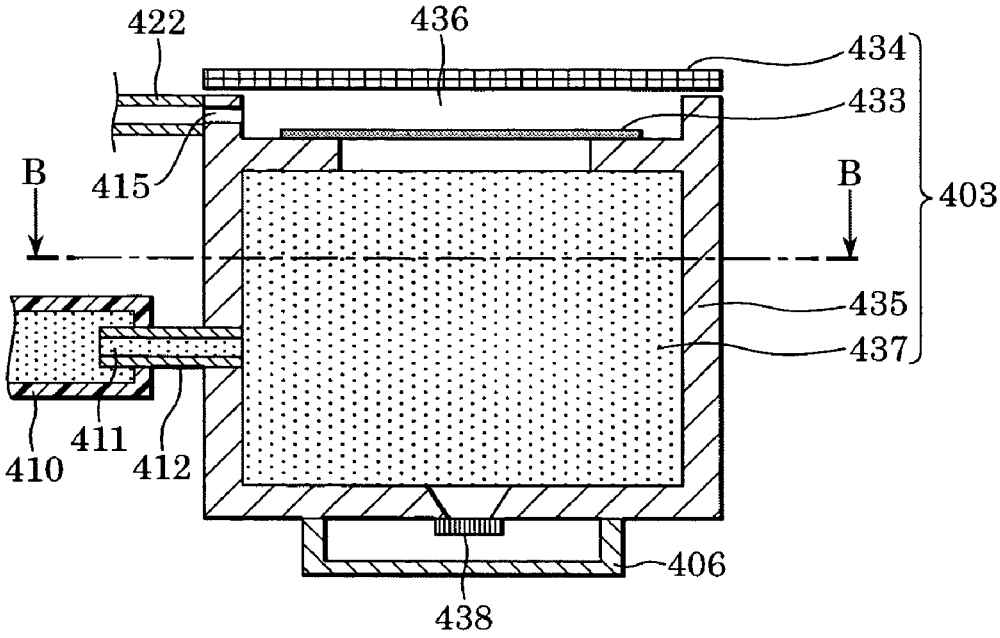
FIG. 7A PRIOR ART
FIGS. 7A and 7B are schematic sectional views showing a conventional pit-stop-type ink-jet recording head with a gas liquid separator.
Figure 7B:
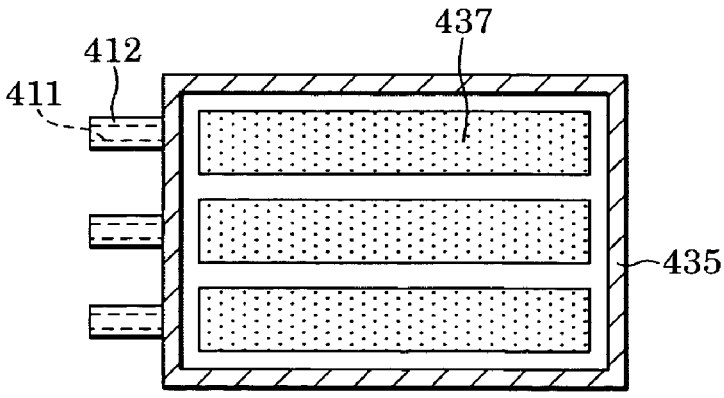
FIG. 7B PRIOR ART

In the conventional ink-jet recording head shown in FIGS. 7A and 7B, the exhaust chamber cover 434 is 2 mm in thickness, and about 2.9 J/g·K in heat capacity. On the other hand, the heat capacity of the container body 435 is about 11.4 J/g·K. The heat capacity of the exhaust chamber cover 434 is very small in comparison with that of the container body 435.

On the other hand, in the first embodiment, the exhaust chamber cover 34 is 15 mm in thickness, and about 21.7 J/g·K in heat capacity. The heat capacity of the exhaust chamber cover 34 is larger than that of the container body 35. In addition, since the container body 35 and the exhaust chamber cover 34 are formed of the same material, they are equal in heat conductivity. Moreover, the thickness of the exhaust chamber cover 34 is comparatively large. Therefore, when the temperature outside the ink container 3 changes, the rate of temperature change of the inner surface of the exhaust chamber cover 34 is slower than that of the inner surface of the container body 35.

The rate of heat transfer from the outer surface to the inner surface of a wall depends on the heat capacity and the heat conductivity of the wall. The larger the heat capacity or the lower the heat conductivity, the slower the rate of temperature change of the wall when the outside temperature changes. Therefore, in the ink container according to the first embodiment, the exhaust chamber cover 34 is thicker than that of the conventional ink container so that the heat capacity of the exhaust chamber cover 34 is larger than that of the container body 35. Therefore, when the temperature outside the ink container changes, the rate of temperature change of the inner surface of the exhaust chamber cover 34 is slower than that of the inner surface of the container body 35.

Figure 2:
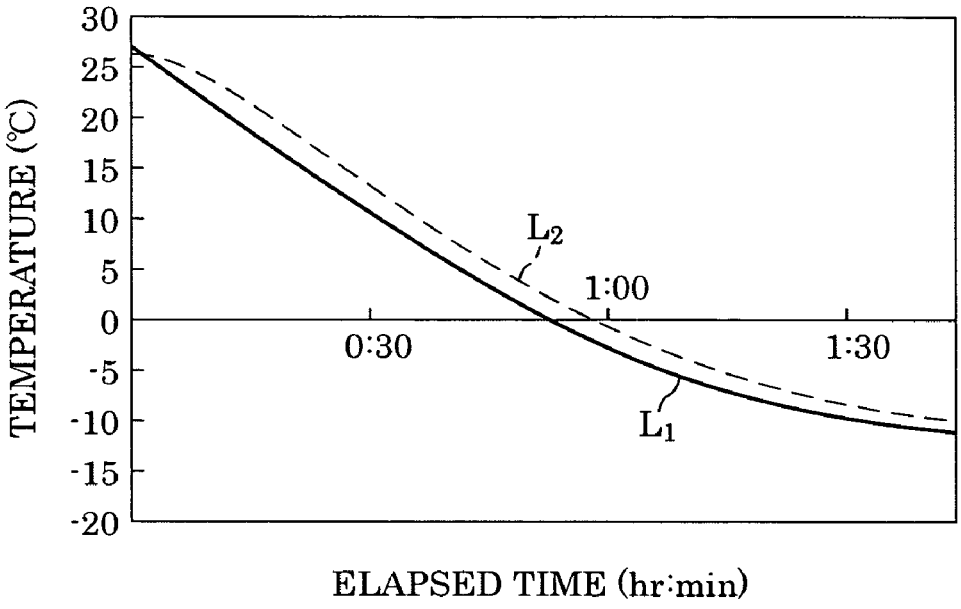
FIG. 2 shows the temperature change on the exhaust chamber side of the gas liquid separator and the temperature change on the ink chamber side of the gas liquid separator when the ink-jet recording head of FIGS. 1A and 1B is shifted from a room temperature environment to a cool temperature environment of −20° C.

FIG. 2 shows the temperature change on the exhaust chamber side of the gas liquid separator 33 and the temperature change on the ink chamber side of the gas liquid separator 33 when the ink-jet recording head is shifted from a room temperature environment to a cool temperature environment of −20° C. In FIG. 2, the solid line $L_1$ shows the temperature change on the exhaust chamber side of the gas liquid separator 33, and the dashed line $L_2$ shows the temperature change on the ink chamber side of the gas liquid separator 33. Measurement of remaining amount of ink, and so on is performed under the same condition as that of the measurement concerning the conventional ink-jet recording head.

Figure 8:
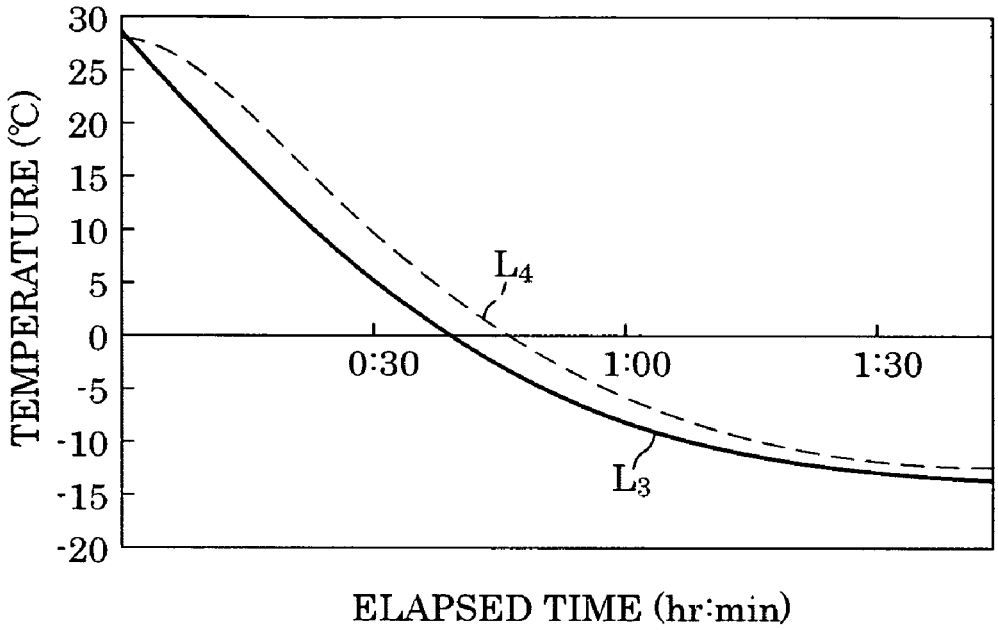
FIG. 8 PRIOR ART
FIG. 8 shows the temperature change on the exhaust chamber side of the gas liquid separator and the temperature change on the ink chamber side of the gas liquid separator when the ink-jet recording head of FIGS. 7A and 7B is shifted from a room temperature environment to a cool temperature environment of −20° C.
Figure 9A:
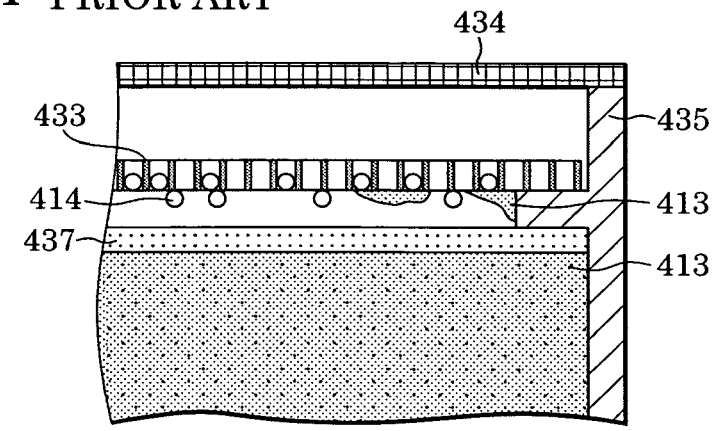
FIG. 9A PRIOR ART
FIGS. 9A to 9C are schematic sectional views showing the state on the surface and in the pores of the gas liquid separator in the ink-jet recording head of FIGS. 7A and 7B.
Figure 9B:
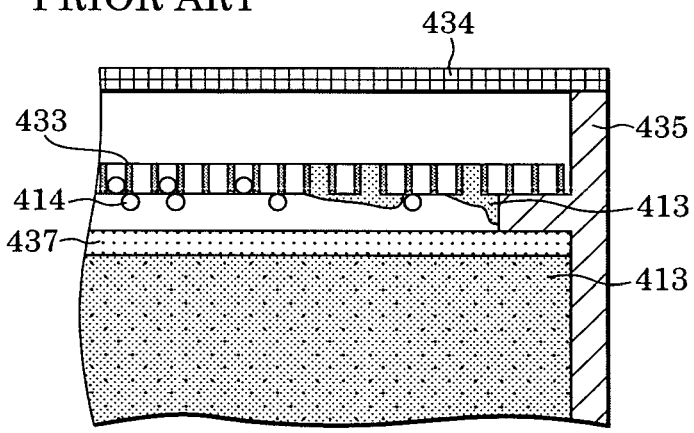
FIG. 9B PRIOR ART
Figure 9C:
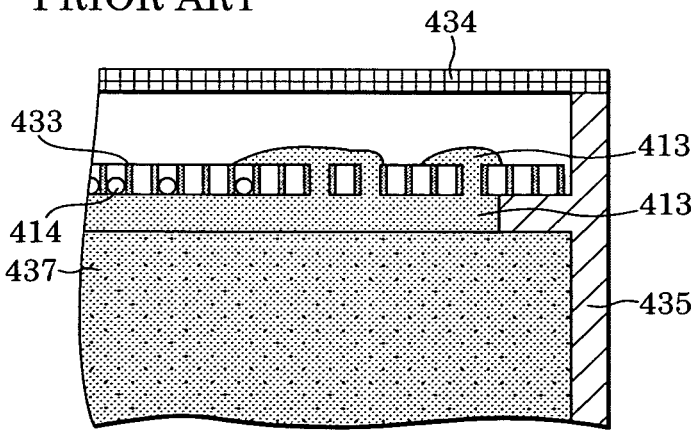
FIG. 9C PRIOR ART

In the conventional ink-jet recording head, as shown in FIG. 8, the temperature on the exhaust chamber side ($L_3$) of the gas liquid separator 433 is about 5° C. lower than the temperature on the ink chamber side ($L_4$).

On the other hand, in the first embodiment, as shown in FIG. 2, the temperature on the exhaust chamber side ($L_1$) of the gas liquid separator 33 is about 2.5° C. lower than the temperature on the ink chamber side ($L_2$). This difference is half of that in the conventional ink-jet recording head. As a cycle test, shifting between a room temperature environment and a cool temperature environment of −20° C. was repeated 10 times. Next, the pit-stop-type ink supply was repeated 1,000 times. The test results showed that ink did not leak through the gas liquid separator 33 into the exhaust chamber 36.

The slight difference between the rates of temperature change on both sides of the gas liquid separator 33 is considered to be caused by the ink existing between the container body 35 and the gas liquid separator 33. However, since the temperature difference is small, no dew condensation is considered to occur.

As described above, when the temperature outside the ink container 3 changes, the rate of temperature change of the inner surface of the exhaust chamber cover 34 is slower than that of the inner surface of the container body 35. Therefore, if any ink remains in the ink chamber 21, no dew condensation occurs on the surface and in the pores of the gas liquid separator 33. As a result, ink does not leak through the gas liquid separator 33. Consequently, the ink-jet recording head according to the first embodiment is reliable.

Second Embodiment

Next, an ink-jet recording head according to a second embodiment will be described. In this ink-jet recording head, an exhaust chamber cover is formed of a different material from that of a container body. In the description of the second embodiment, the same reference numerals will be used to designate the same components as those in the first embodiment so that the description will be omitted.

Figure 3:
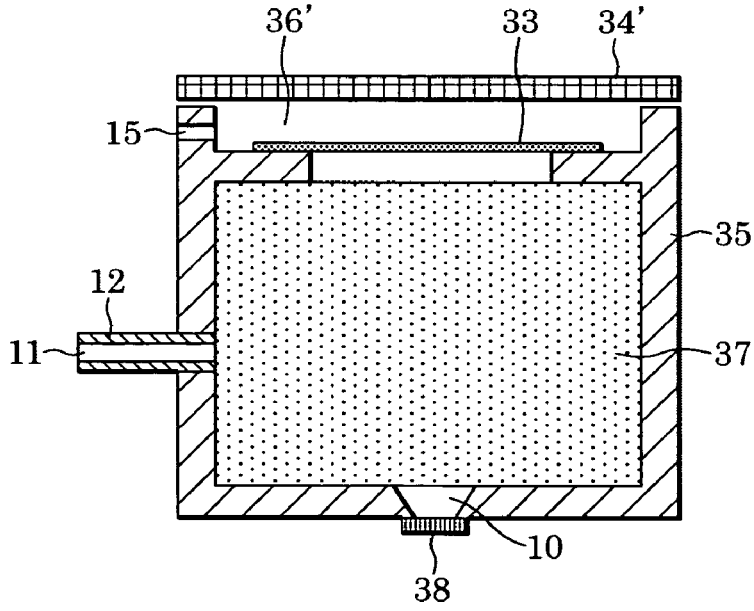
FIG. 3 is a schematic sectional view showing an ink-jet recording head with a gas liquid separator according to a second embodiment.
Figure 4:
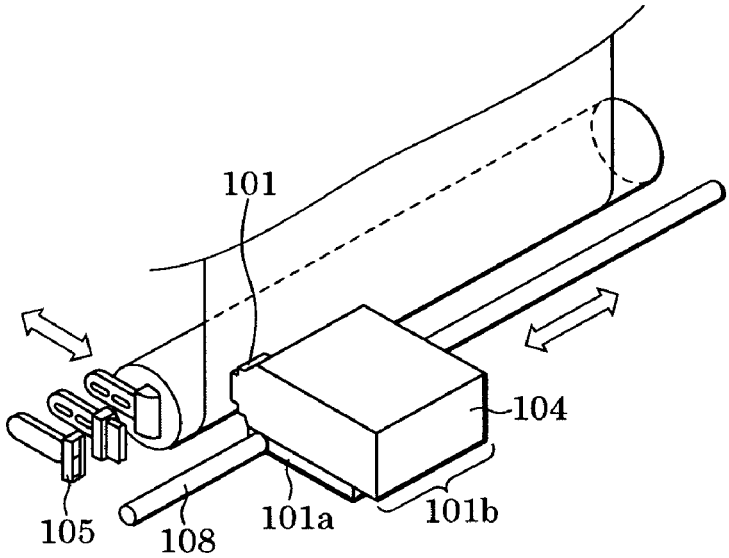
FIG. 4 is a perspective view showing a head-cartridge-type recording apparatus.
Figure 5:
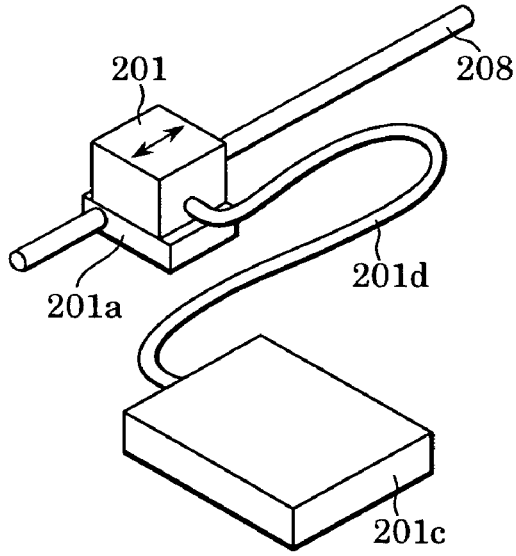
FIG. 5 is a perspective view showing a tube-supply-type recording apparatus.

FIG. 3 is a sectional view showing an ink-jet recording head according to the second embodiment.

In the present embodiment, an exhaust chamber cover 34' is formed of foamed polyethylene, the heat conductivity of which is lower than that of polysulfone resin. The exhaust chamber cover 34' is glued on the edge at the top of the container body 35.

The exhaust chamber cover 34' is 2 mm in thickness as in the conventional exhaust chamber cover 434. However, the heat conductivity of foamed polyethylene forming the exhaust chamber cover 34' is 0.035 W/m·K. This is very low in comparison with the heat conductivity of polysulfone resin, 0.26 W/m·K.

Therefore, although the exhaust chamber cover 34' of the second embodiment is smaller than the exhaust chamber cover 34 of the first embodiment in thickness, the exhaust chamber cover 34' has comparatively high insulation. Consequently, the difference in rate of temperature change between both sides of the gas liquid separator 33 is small. Therefore, in a cool temperature environment, this exhaust chamber cover 34' can reduce or prevent the dew condensation in the pores of the gas liquid separator 33. Consequently, when ink is supplied, ink does not leak through the gas liquid separator 33.

As described above, in the second embodiment, the exhaust chamber cover 34' and the container body 35 are formed of different materials, and the material of the exhaust chamber cover 34' has a lower heat conductivity than that of the container body 35. Therefore, the exhaust chamber cover 34' need not be thick, unlike the first embodiment in which the exhaust chamber cover 34 and the container body 35 are formed of the same material. Consequently, the ink container and the ink-jet recording head according to the second embodiment are smaller than those of the first embodiment.

In the second embodiment, the container body 35 is formed of polysulfone resin, and the exhaust chamber cover 34' is formed of foamed polyethylene. However, materials are not limited to these. Any materials may be used as long as the material of the exhaust chamber cover 34' has a lower heat conductivity than that of the container body 35.

In the second embodiment, in order to prevent the dew condensation, the heat conductivity of the exhaust chamber cover 34' is reduced, and the temperature change on the exhaust chamber side of the gas liquid separator 33 is slowed. Alternatively, the heat capacity of the exhaust chamber cover 34' may be increased. An increase in the heat capacity of the exhaust chamber cover 34' also slows the temperature change on the exhaust chamber side of the gas liquid separator 33.

Therefore, the exhaust chamber cover 34' may be formed of a material whose specific heat is greater than 1.3 J/g·K, that is to say, the specific heat of polysulfone resin forming the container body 35. Also in this case, the exhaust chamber cover 34' need not be thick, unlike the first embodiment in which the exhaust chamber cover 34 and the container body 35 are formed of the same material, and the ink leakage through the gas liquid separator 33 is prevented.

In the above-described embodiments, the gas liquid separator is almost as wide as the exhaust chamber cover. However, the gas liquid separator may be smaller. In this case, at least the part of the exhaust chamber cover that faces the gas liquid separator needs to be formed of a material whose heat capacity is larger than that of the container body or a material whose heat conductivity is lower than that of the container body.

Alternatively, at least a part of the exhaust chamber cover may be formed of a material whose heat capacity is larger than that of the container body. Alternatively, at least a part of the exhaust chamber cover may be formed of a material whose heat conductivity is lower than that of the container body.

Figure 6:
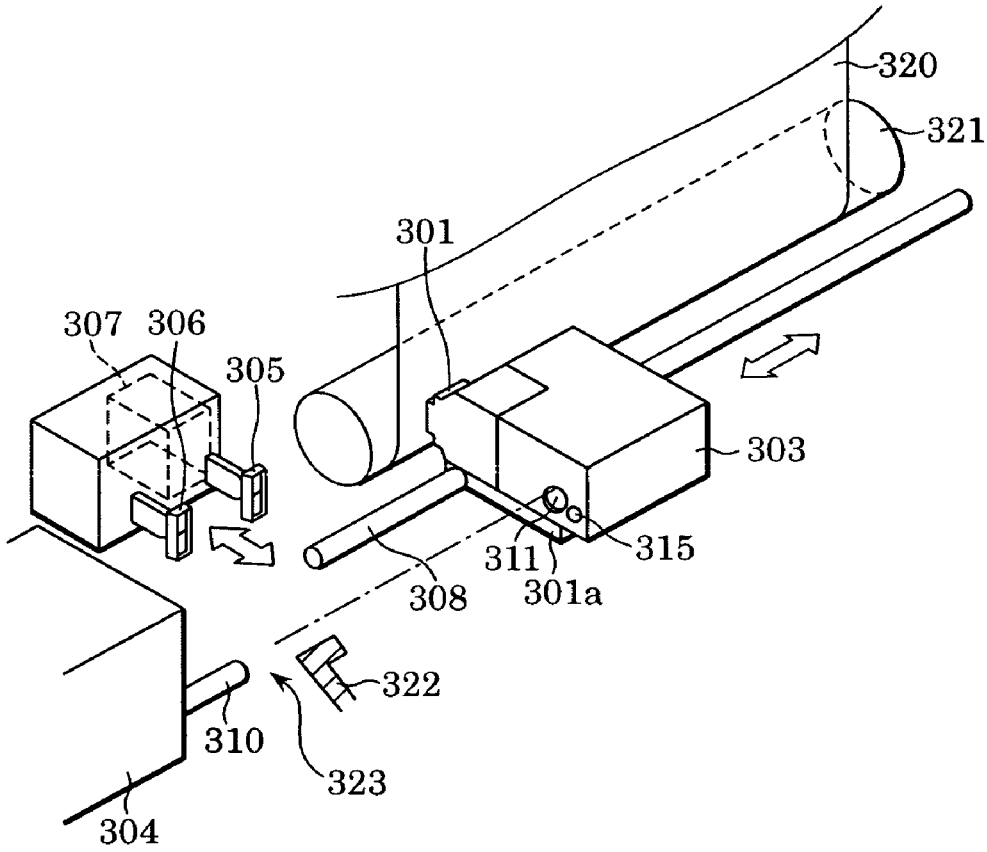
FIG. 6 is a perspective view showing a pit-stop-type recording apparatus.

As for the ink-jet recording apparatus including the ink-jet recording head according to the second embodiment, since it has the same structure as that of the conventional ink-jet recording apparatus shown in FIG. 6, the description will be omitted.

Since the ink-jet recording head according to the second embodiment is small, the use of this head reduces the size and manufacturing cost of the ink-jet recording apparatus.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-124253 filed Apr. 20, 2004, which is hereby incorporated by reference herein.

What is claimed is:

1. An ink container for supplying ink to an ink-jet recording element, the ink container comprising:

a container body including an ink chamber holding ink and an exhaust chamber facilitating exhausting air from the ink chamber, the ink chamber having an ink outlet and an ink inlet, the exhaust chamber having a vent;

a gas liquid separator disposed between the ink chamber and the exhaust chamber; and an exhaust chamber cover covering the exhaust chamber and configured such that, when temperature outside the ink container changes, a rate of temperature change of an inner surface of the exhaust chamber cover is slower than a rate of temperature change of an inner surface of the container body.

2. The ink container according to claim 1, wherein the exhaust chamber cover includes a part having heat conductivity lower than a heat conductivity of the container body.

3. The ink container according to claim 2, wherein the part of the exhaust chamber cover faces the gas liquid separator.

4. The ink container according to claim 1, wherein the exhaust chamber cover includes a part having specific heat greater than a specific heat of the container body.

5. The ink container according to claim 4, wherein the part of the exhaust chamber cover faces the gas liquid separator.

6. An ink-jet recording head comprising the ink container according to claim 1; and an ink-jet recording element receiving ink from the ink container.

7. A recording apparatus comprising the ink container according to claim 1, the recording apparatus discharging ink onto a recording medium so as to perform recording.

8. An ink container for supplying ink to an ink-jet recording element, the ink container comprising:

a container body including an ink chamber holding ink and an exhaust chamber facilitating exhausting air from the ink chamber, the ink chamber having an ink outlet and an ink inlet, the exhaust chamber having a vent;

a gas liquid separator disposed between the ink chamber and the exhaust chamber; and an exhaust chamber cover covering the exhaust chamber and including a part having heat conductivity lower than a heat conductivity of the container body.

9. An ink container for supplying ink to an ink-jet recording element, the ink container comprising:

a container body including an ink chamber holding ink and an exhaust chamber facilitating exhausting air from the ink chamber, the ink chamber having an ink outlet and an ink inlet, the exhaust chamber having a vent;

a gas liquid separator disposed between the ink chamber and the exhaust chamber; and an exhaust chamber cover covering the exhaust chamber and including a part having specific heat greater than a specific heat of the container body.

* * * * *